United States Patent [19]

Larinoff

[11] Patent Number: 4,903,491

[45] Date of Patent: Feb. 27, 1990

[54] AIR-COOLED VACUUM STEAM CONDENSER

[76] Inventor: Michael W. Larinoff, 370 Holly Hill Rd., Oldsmar, Fla. 34677

[21] Appl. No.: 206,094

[22] Filed: Jun. 13, 1988

[51] Int. Cl.[4] ..... F28B 3/00

[52] U.S. Cl. ..... 60/692; 165/111

[58] Field of Search ..... 165/111, 113, 114, 146, 165/900; 60/690, 692

[56] References Cited

U.S. PATENT DOCUMENTS

| | | | |
|---|---|---|---|
| 3,556,204 | 1/1971 | Dehne | 165/111 XR |
| 3,707,185 | 12/1972 | Modine et al. | 165/111 |
| 4,168,742 | 9/1979 | Kluppel et al. | 165/114 |
| 4,518,035 | 5/1985 | Larinoff | 165/101 |

*Primary Examiner*—Allen M. Ostrager

*Attorney, Agent, or Firm*—Dominik, Stein, Saccocio, Reese, Colitz & Van Der Wall

[57] ABSTRACT

An improved air-cooled vacuum steam condenser in a steam turbine cycle comprising a steam powered system comprising a turbine for converting steam energy into mechanical energy upon expansion of steam therein, a boiler for generating steam to be fed to the turbine, and a conduit arrangement coupling the boiler to the turbine and then recoupling the turbine exhaust to the boiler through steam condensing mechanisms, the condensing mechanisms include a plurality of finned tubes through which the expanded exhaust steam flows and is condensed; a plurality of bundle front headers at the input ends of the condensing tubes for receiving exhaust steam from the turbine; a plurality of bundle rear headers at the output ends of the condensing tubes for receiving condensate and non-condensible gasses; a plurality of vertically oriented water leg pipes, one for each bundle rear header of each bundle, coupling each rear header with a water leg manifold; a hydraulic balance device in the condensate drain system coupling the water leg manifold and a condensate storage tank, the hydraulic balance device providing the means to maintain a predetermined hydraulic pressure therein for thereby sustaining the heights of the condensate in the water leg pipes within predetermined limits for fluid sealing purposes; and means to remove non-condensible gasses from the rear headers.

23 Claims, 11 Drawing Sheets

FIG. 2
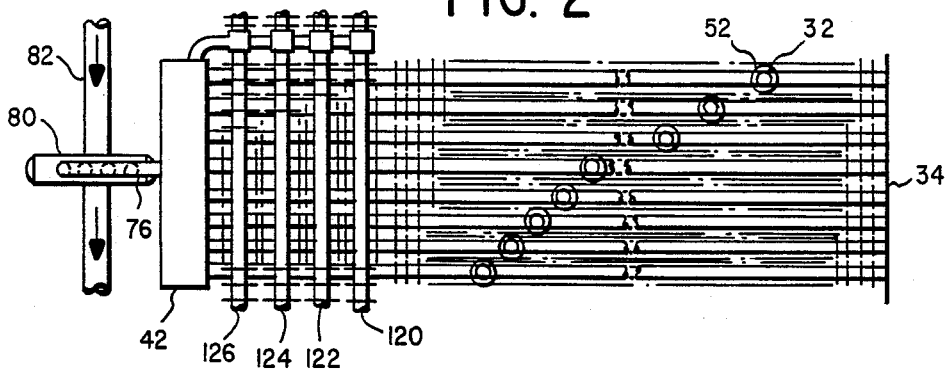
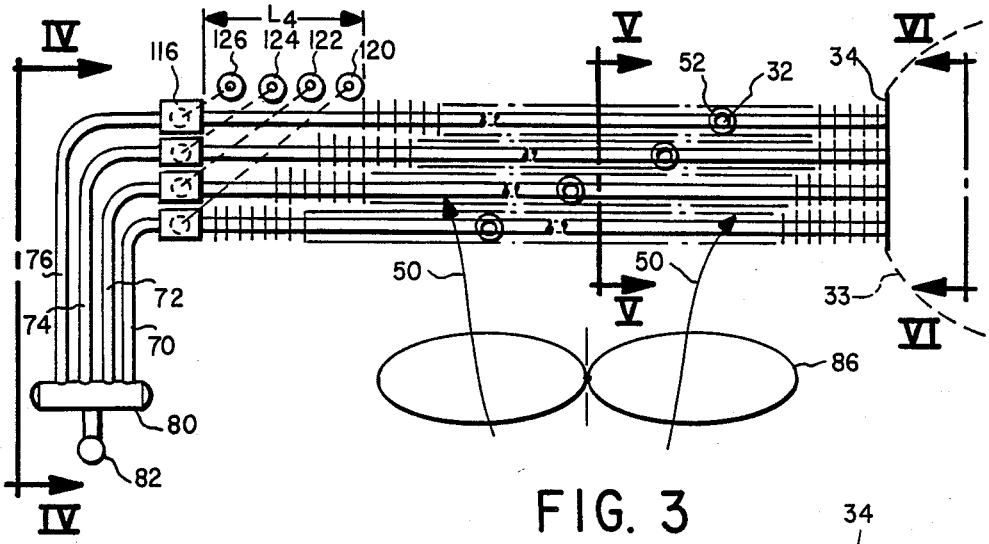
FIG. 3
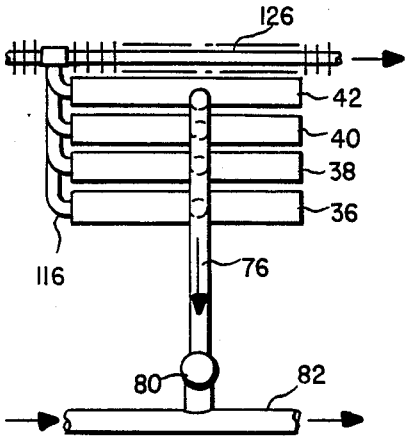
FIG. 4
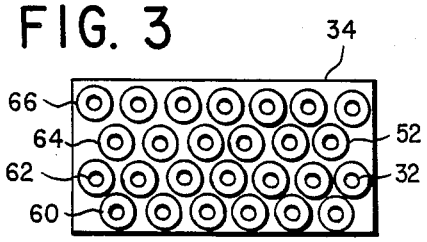
FIG. 5
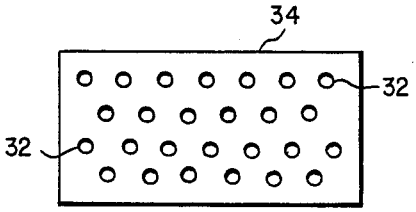
FIG. 6

FIG. 8
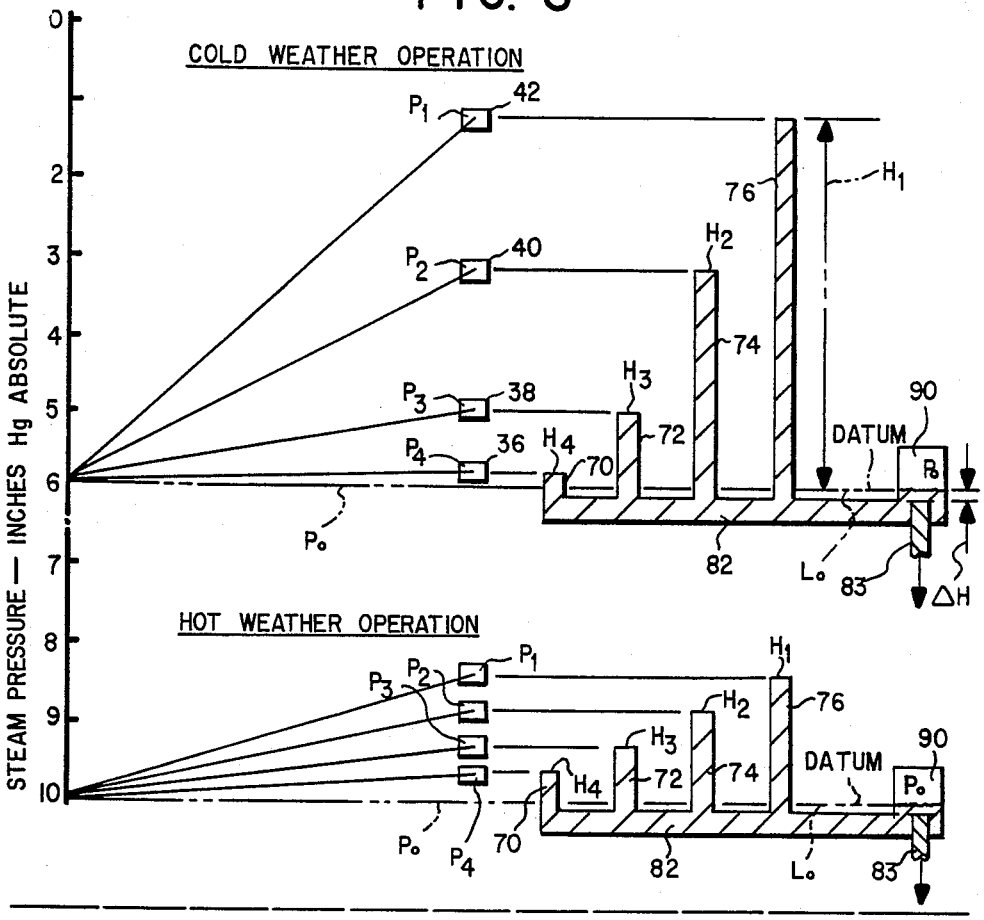
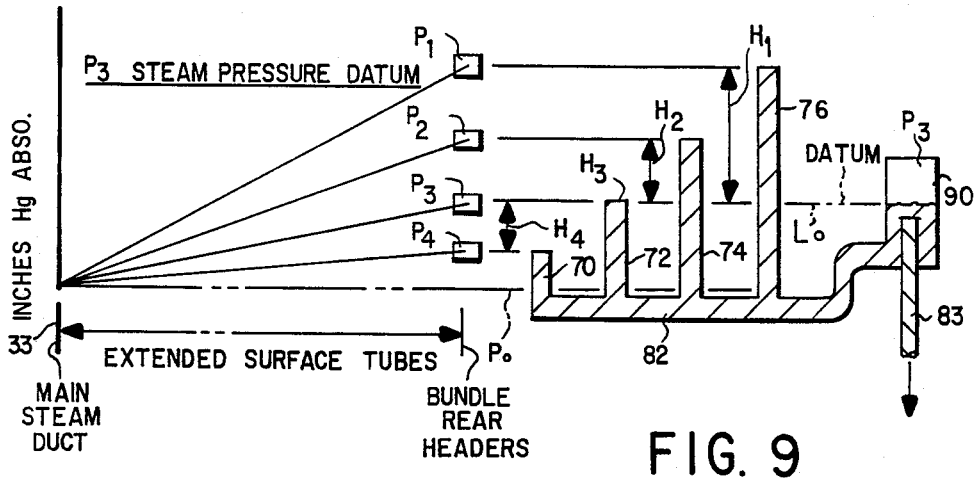
FIG. 9

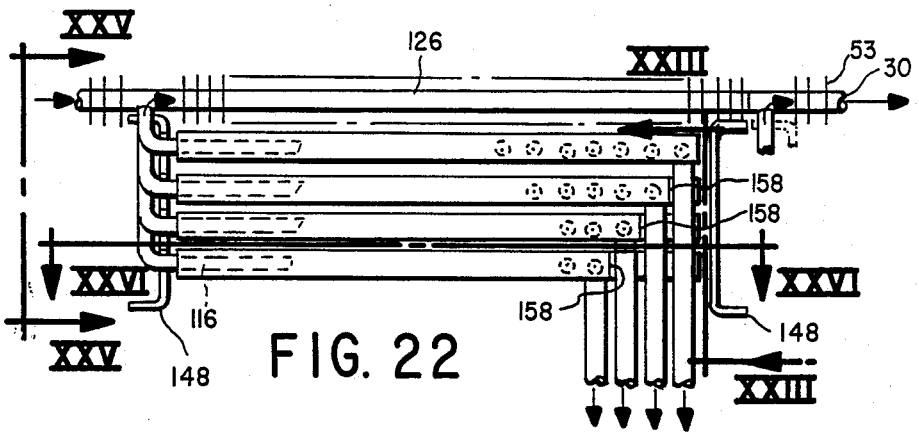
FIG. 22
FIG. 24
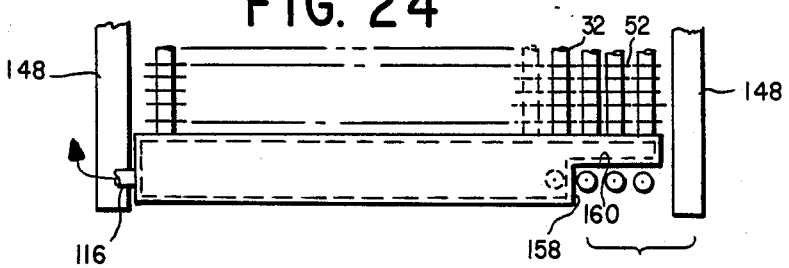
FIG. 23
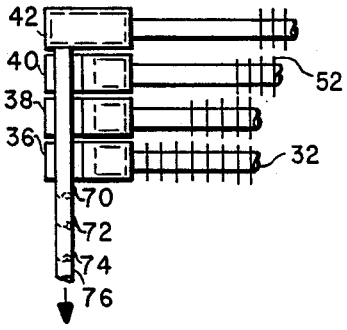
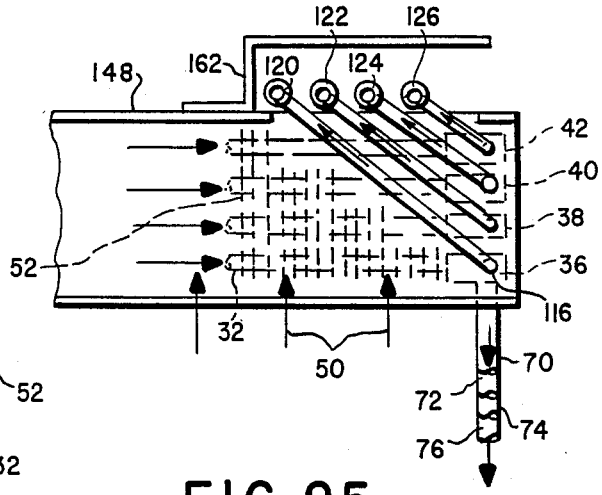
FIG. 25

AIR-COOLED VACUUM STEAM CONDENSER

BACKGROUND OF THE INVENTION

This invention relates to air-cooled vacuum steam condensers serving steam turbine power cycles or the like and, more particularly, to apparatus for condensing steam or other vapors and draining the condensate over a wide range of loads, pressures and ambient air temperatures and also completely removing the steam-transported, undesirable, non-condensible gasses that migrate and collect at the end of the steam condensing system.

DESCRIPTION OF THE BACKGROUND ART

One technique for generating mechanical energy is the use of a turbine, boiler and an array of coupling conduits. Water is first converted to steam in the boiler. The steam is then conveyed to the turbine wherein the steam is expanded in its passage through rotating blades thereby generating shaft power. An array of conduits couple the turbine and the boiler and also define a working fluid return path from the turbine back to the boiler through steam condenser mechanisms in a continuing cycle of operation.

Steam condenser mechanisms include air-cooled vacuum steam condensers which may be considered as being comprised of four basic elements or systems: the steam condensing system, the air moving system, the condensate drain system and the non-condensible gas removal system.

The main problems plaguing the industry today are in the condensate drain and non-condensible gas removal systems that result in condensate freezing followed by the rupturing of bundle drains and heat exchanger tubes. The reasons for their failures can be traced to faulty condensate-drain hydraulic-design, the trapping of non-condensible gasses in the rear headers of the heat exchanger bundles and inadequate freeze protection. The problems are aggravated further by the wide range of plant operating conditions imposed upon the equipment and by low ambient air temperatures coupled with high winds.

Various approaches are disclosed in the patent literature to improve the efficiency, hydraulics, freeze protection and control of air-cooled vacuum steam condensers and related devices. By way of example, note U.S. Pat. Nos. 2,217,410 to Howard and 3,289,742 to Niemann. These patents disclose early versions of heat exchangers for use in turbine systems. Other patents relating to improving air-cooled system steam condensers include U.S. Pat. Nos. 2,247,056 to Howard and 3,429,371 to Palmer. These patents are directed to control apparatus for accommodating pressure variations. In addition, U.S. Pat. No. 4,585,054 to Koprunner is directed to a condensate draining system. The linear arrangement of tubes in A-frame steam condensers is disclosed in U.S. Pat. Nos. 4,177,859 to Gatti and 4,168,742 to Kluppel while U-shaped tubes are disclosed in U.S. Pat. Nos. 3,705,621 and 3,887,002 to Schoonman. In addition, applicant Larinoff describes a wide variety of improvements in air-cooled heat exchangers in his prior U.S. Pat. Nos. 3,968,836; 4,129,180; 4,240,502 and 4,518,035. Such improvements relate to condensate removal, air removal, tube construction, cooling controls and the like. Lastly, various improvements in mechanisms for non- analogous technologies are disclosed in U.S. Pat. Nos. 2,924,438 to Malkoff; 3,922,880 to Morris and 4,220,121 to Maggiorana.

As illustrated by the great number of prior patents and commercial devices, efforts are continuously being made in an attempt to improve air-cooled vacuum steam condensers having particular utility in systems configuration with steam turbine cycles. Such efforts are being made to render condensers more efficient, reliable, inexpensive and convenient to use, particularly over a wider range of thermal operating conditions. None of these previous efforts, however, provides the benefits attendant with the present invention. Additionally, the prior patents and commercial devices do not suggest the present inventive combination of component elements arranged and configured as disclosed and claimed herein. The present invention achieves its intended purposes, objects and advantages over known devices through a new, useful and unobvious combination of component elements, with the use of a minimum number of functioning parts, at a reasonable or lower cost to manufacture, and by employing only readily available materials.

Therefore, it is an object of this invention to improve steam powered systems comprising a turbine for converting steam energy into mechanical energy upon expansion of steam therein, a boiler for generating steam to be fed to the turbine, and a conduit arrangement coupling the boiler to the turbine and then recoupling the turbine exhaust to the boiler through steam condensing mechanisms. The condensing mechanisms include a plurality of finned tubes through which the expanded exhaust steam flows and is condensed; a plurality of bundle front headers at the input ends of the condensing tubes for receiving exhaust steam from the turbine; a plurality of bundle rear headers at the output ends of the condensing tubes for receiving condensate and non-condensible gasses; a plurality of vertically oriented water leg pipes, one for each bundle rear header of each bundle, coupling each rear header with a water leg manifold; a hydraulic balance device in the condensate drain system coupling the water leg manifold and a condensate storage tank, the hydraulic balance device providing the means to maintain a predetermined hydraulic pressure therein for thereby sustaining the heights of the condensate in the water leg pipes within predetermined limits for fluid sealing purposes; and means to remove non-condensible gasses from the rear headers.

It is another object of the instant invention to operate air-cooled steam condensers for steam turbine applications at increased efficiencies, hydraulic stability and safety over a wide range of ambient air temperatures, steam pressures and steam loads.

It is yet another object of this invention to properly and completely drain condensate from air-cooled steam condenser systems and protect them from freezing.

Lastly it is a further object of the present invention to completely remove undesired gasses from the terminal points of a steam condensing system which are the cause of freezing problems and tube corrosion.

The foregoing has outlined some of the more pertinent objects of the invention. These objects should be construed to be merely illustrative of some of the more prominent features and applications of the intended invention. Many other beneficial results may be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into a turbine for converting steam energy into mechanical energy upon expansion of steam therein, a boiler for generating steam to be fed to the turbine, and a conduit arrangement coupling the boiler to the turbine and then recoupling the turbine exhaust to the boiler through steam condensing mechanisms. The condensing mechanisms include a plurality of finned tubes through which the expanded exhaust steam flows and is condensed; a plurality of bundle front headers a the input ends of the condensing tubes for receiving exhaust steam from the turbine; a plurality of bundle rear headers at the output ends of the condensing tubes for receiving condensate and non-condensible gasses; a plurality of vertically oriented water leg pipes, one for each bundle rear header of each bundle, coupling each rear header with a water leg manifold; a hydraulic balance device in the condensate drain system coupling the water leg manifold and a condensate storage tank, the hydraulic balance device providing the means to maintain a predetermined hydraulic pressure therein for thereby sustaining the heights of the condensate in the water leg pipes within predetermined limits for fluid sealing purposes; and means to remove non-condensible gasses from the rear headers.

The plurality of condensing tubes are arranged in bundles, with the tubes of each bundle installed in a plurality of rows with the condensing pipes of each row terminating in a separate rear header. The system further includes a plurality of bundles with each bundle having rows of condensing tubes in a plurality of front headers and in a plurality of rear headers and a plurality of water leg pipes coupled with a common condensate manifold for directing the condensate flow of a plurality of bundles therefrom to the hydraulic balance device. Each water leg pipe couples with its associated rear header at a different elevational location with the ends of the lower rear headers being cut centrally along their axes for forming notches to allow passage of some of the water leg pipes therepassed. The water leg pipes may be parallel with each other in a planar configuration or may be parallel with each other and arranged in a circular configuration with a tubular jacket surrounding the water leg pipes and means to effect a heating steam flow into the jacket via a protected steam line and further including means for winterizing the exposed vertically oriented water leg pipes.

The invention may also be incorporated into an improved condensing and draining mechanism for use in a steam condenser comprising a plurality of condensing tubes through which steam may flow for being condensed into water and continually drained therefrom; a plurality of front headers at the input end of the condensing tubes for receiving steam to be condensed; a plurality of rear headers at the output ends of the condensing tubes for receiving condensate and non-condensible gasses from the condensing tubes; a plurality of heat transfer fins on the condensing tubes to facilitate steam condensing within the tubes, such finned tubes extending from the front headers toward the rear headers with, in the area below the pre-condensers, the fins being removed from the tubes for varying predetermined lengths to control air temperature enveloping the pre-condenser tubes; a plurality of water leg pipes, each coupling a rear header with a water leg manifold; and a hydraulic balance device through which all the condensate will flow from all the water leg manifolds, such hydraulic balance device including an inverted U-shaped pipe mechanism located at the water level datum line for water in the water leg pipes and with means for maintaining the bight of the U-shaped pipe at a predetermined hydraulic pressure. The water level datum line is located at a predetermined elevation measured from the lower ends of the water leg pipes and at the bight of the U-shaped pipe. The mechanism further includes a steam pressure chamber at the upper extent of the bight of the U-shaped pipe. The mechanism further includes a vent tube in the U-shaped pipe adjacent the bight. The mechanism further includes means operatively coupling the bight of the U-shaped tube with a predetermined steam pressure source. The steam pressure source is the main steam duct. The steam pressure source is any one row of the bundle rear headers. The plurality of condensing tubes are arranged in a plurality of rows with the condensing tubes of each row terminating in a separate rear header and with a separate water leg pipe coupling each rear header with a water inlet manifold and the mechanism further includes a plurality of bundles with each bundle including rows of condensing tubes, rear headers and water leg pipes coupled with a common condensate manifold for a plurality of bundles for directing the condensate flow from the plurality of bundles to the hydraulic balance device.

The invention may yet further by incorporated into improved mechanisms to remove non-condensible gasses from a steam condenser comprising a plurality of condensing tubes through which exhaust steam may flow for being condensed into water and non-condensible gasses to be removed; a plurality of front headers at the input end of the condensing tubes for receiving exhaust steam to be condensed; a plurality of rear headers at the output ends of the condensing tubes for receiving condensate and non-condensible gasses from the condensing tubes; a plurality of water leg pipes, each coupling an output header pipe with a common water leg manifold; a suction sparger with orifices installed within each of the rear headers to receive non-condensible gasses and water vapor; and connecting piping extending from each suction sparger to its companion precondenser tube for the removal of the non-condensible gasses and some water vapor.

The plurality of condensing tubes are arranged in bundles with a plurality of rows of condensing tubes in each bundle and with each row of each bundle terminating in a separate rear header and with a separate suction sparger installed in each rear and last header and a separate water leg pipe coupled with each rear header and with a separate water leg manifold for each bundle. The mechanism further includes air-cooled precondenser tubes set in a select and pre-determined air temperature zone on the discharge side of the main condenser coupling a preselected suction sparger from each tube row of each bundle. The mechanisms further includes a suction-type air removal device such as a first-stage steam jet air ejector for each pre-condenser tube row. The mechanisms further include an inter-condenser, a second-stage ejector and an after-condenser coupled to the output of the first-stage steam jet air ejector. The orifices in the suction sparger are of varying diameters for equalizing the mass flow of non-condensible gas mixtures in each row (i) along the length of the rear headers and from the (ii) various bundles as located throughout the tower structure.

The invention may also be incorporated into a device for condensing steam and for removing the non-condensible gasses therefrom. The device includes an arrangement of conduits defining a gas/vapor path extending from a front header to a rear header with condensing tubes extending therebetween for the steam as it moves from the front header toward the rear and last header, a suction sparger operatively associated with the last header for the receipt of the non-condensible gasses released from the steam during its condensation and movement along the condensing tubes and for the removal of such non-condensible gasses from the system.

Lastly, the invention may be incorporated into apparatus for removing non-condensible gasses from steam being condensed as it moves through tubes from a front header toward a rear header. Means are located in the rear and last header for the receipt of the non-condensible gasses released from the steam, the means having a plurality of orifices along its length for the receipt of the non-condensible gas mixture and for the removal of this mixture therefrom by a suction-type air removal device such as a steam operated first-stage ejector.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIGS. 2, 3, 4, 5 and 6 are detailed views of one steam condensing bundle of which there are a plurality in an installation, as shown in FIGS. 1 and 17.

FIG. 2 is a plan view of a single bundle.

FIG. 3 is an elevation view of a bundle designed for an inclined installation. The fan beneath merely illustrates the forced movements of air along the full length of the bundle.

FIG. 4 is an elevation view looking at the rear header end of the bundle.

FIG. 5 is a sectional view through the bundle showing finned tubes stacked four rows deep.

FIG. 6 is a view of the front header showing its tube holes where the exhaust steam enters the steam condensing mechanism from the main steam duct.

FIG. 8 graphs illustrate typical hydraulic pressures in the condensate water leg drain system during different ambient air temperatures.

FIG. 9 shows the water leg heights that would exist if the pressure balancing device were connected to the third row rear header pressure instead of to the main steam duct as shown in FIG. 8.

FIGS. 10, 11, 12, 13, 14, 15 and 16 are water leg seals design details.

FIG. 10 is an elevation view of a simple, standard, water leg seal assembly.

FIG. 11 is a sectional view of FIG. 10 taken along lines 11—11.

FIG. 12 is an elevation view of a modified array of water leg seals.

FIG. 13 is a sectional view of FIG. 12 taken along lines 13—13.

FIG. 14 is a winterized steam heated version of FIG. 7 design water leg seals while FIG. 11 and 13 are sectional views thereof taken along lines 11—11 and 13—13 thereof.

FIG. 15 is an end view of the upper portion of the array of water legs, rear header pipes and condensing tubes shown in FIG. 14.

FIG. 16 is a plan view of the fourth row water leg shown in FIG. 14 with a non-condensible gas removal tube.

FIGS. 17, 18, 19, 20, 21, 22, 23, 24, 25, 26 and 27 are the non-condensible gas removal system design details.

FIG. 17 is a flow diagram of the gas removal vacuum system showing the pre-condenser tubes resting on top of the bundles close to the rear headers.

FIG. 18 is an elevational view of the four rear headers of one typical bundle with their suction spargers, taken in the direction of line 18—18 of FIG. 17.

FIG. 19 is an elevational view of the suction sparger shown installed in a rear header.

FIG. 20 is an enlarged, partially sectional illustration of one rear header of a horizontal bundle including, in section, the suction sparger.

FIG. 21 is an enlarged, partially sectional illustration similar to FIG. 20 but showing an inclined bundle.

FIG. 22 is an elevational view of the rear header and external piping arrangement for a horizontal bundle while FIG. 23 is an end view thereof and also showing the vacuum system pre-condenser resting on the top of the bundle frame.

FIG. 24 is a plan view of the first row rear header shown in FIG. 22 taken along line 24—24 thereof.

FIG. 25 is an elevational view of the rear header and vacuum system pre-condensers taken along line 25—25 thereof.

FIG. 26 is an elevational view of the rear header and external piping arrangement for an inclined bundle while FIG. 27 is an enlarged end view taken along line 27—27 thereof showing the vent piping from the suction spargers connecting to the pre-condensers.

Similar referenced numerals refer to similar parts throughout the several Figures.

DETAILED DESCRIPTION OF THE INVENTION

Overview

Figure 1:
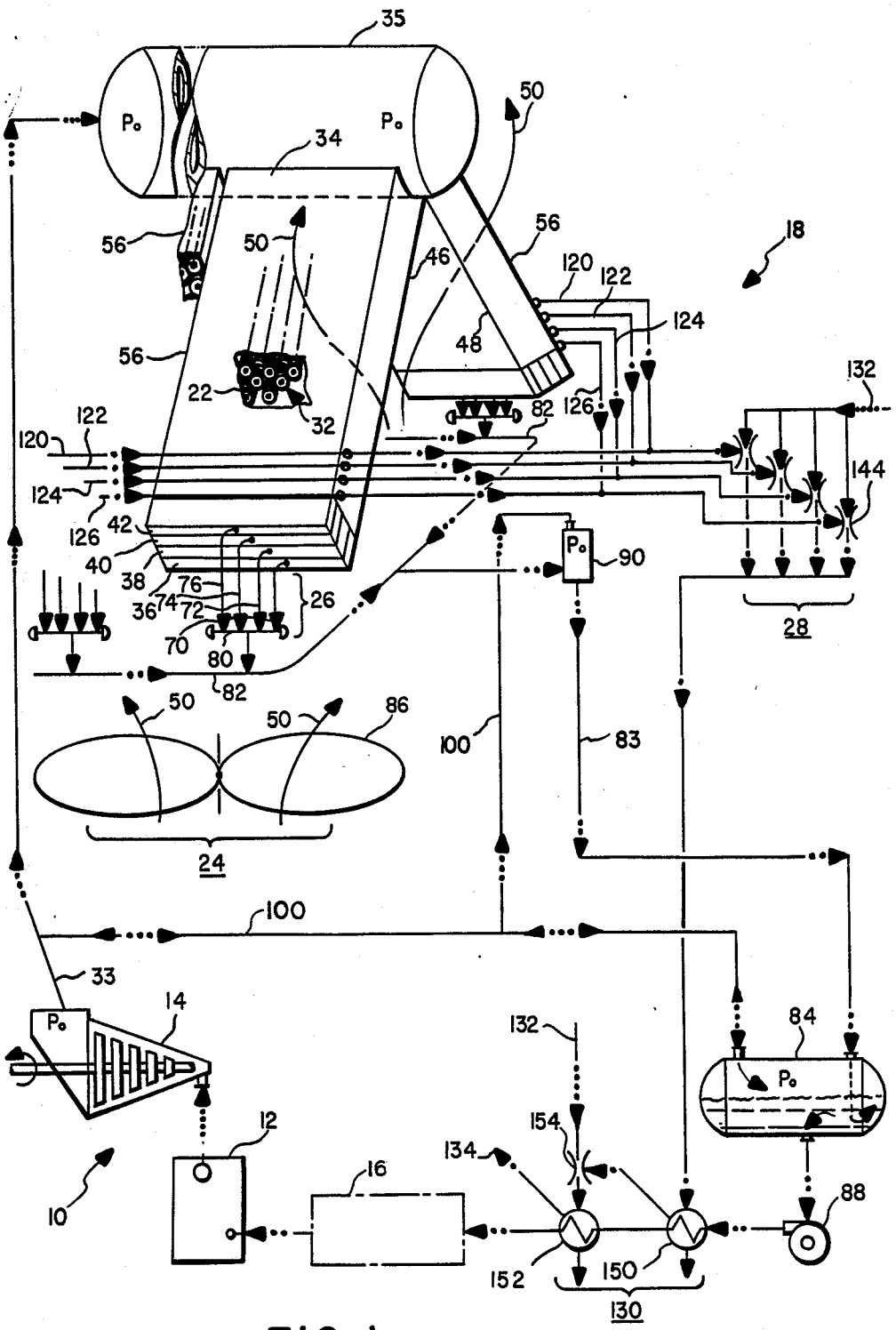
FIG. 1 is a simplified version of a steam power cycle that is a partially schematic, partially diagrammatic illustration of a boiler, turbine, pumps, and coupling conduits with an air cooled steam condenser. The condenser shown is of an "A" frame design with mechanical draft, condensate drain, condensate storage tank and a two-stage steam operated, air-removal system.

With particular reference to FIG. 1, there is shown a power system 10 for converting thermal energy into mechanical energy. The system includes a boiler 12 for converting water to steam, a turbine 14 for receiving the steam from the boiler wherein the steam is expanded to rotate the blades of the turbine producing shaft power. A conduit arrangement 16 conveys steam from the boiler 12 to the turbine 14 and steam as well as condensate from the turbine exhaust back to the boiler through a conduit arrangement 16. The conduits supplied by a mainstream duct 33 include mechanisms 18 for condensing the expanded exhaust steam into water for reuse in a continuous, recirculating cycle of operation. The conduits constitute a sub-system which may be considered as including a steam condensing system 22, an air moving system 24, a condensate drain system 26 and a gas removal vacuum system 28.

Steam Condensing System

The steam condensing mechanism 18 employed in the preferred embodiment of the present invention consists of a steam supply duct 35 to which the steam condensing bundles 56 with frames 148 are attached at the front header 34. The exhaust steam flows through a plurality of parallel finned tubes 32 where it is condensed and the condensate then flows in parallel with the steam to a plurality of bundle rear headers 36, 38, 40 and 42. In the disclosed preferred embodiment, the bundles are arranged in two banks, 46 and 48, in an A-frame configuration with the front header 34 at the top thereof commonly feeding all tubes 32. The tubes are provided with fins 52 to facilitate and promote more efficient heat transfer. The heat transfer involves the flow of ambient air 50 over the finned tubes for cooling purposes to condense the steam into water. The condenser tubes of each bank are separated into a plurality of bundles 56, only one of which is shown in FIGS. 2, 3, 4, 5 and 6, the plurality of bundles in one bank may be seen in FIGS. 1 and 17. Within each bundle, the tubes are arranged in a plurality of rows 60, 62, 64 and 66, four in the disclosed preferred embodiment. The first row 60 of tube 32 is located along the lowermost line and is the first to be contacted by the cooling air 50. The fourth or uppermost row 66 of tubes 32 is located in the most elevated line and is the last to be contacted by the cooling air 50. Two intermediate rows 62 and 64, the second and the third, are located therebetween so that four parallel rows are symmetrically positioned in each bundle.

Each row of tubes has its own rear header 36, 38, 40 and 42. Each of the four rear headers is then coupled with a pipe 70, 72, 74 and 76 constituting a water leg leading into a common water leg manifold 80. The water leg manifolds for each bank drain to a common condensate manifold 82 for fluid flow into the hydraulic balance device 90 and then into the condensate storage tank 84.

The steam condensing system employed in this invention may thus be considered as consisting of multi-row extended surface, air-cooled, heat exchanger bundles. The tube rows with their separate rear headers, are in a single pass arrangement in relation to the air flow while the steam and its condensate are in parallel flow. For example, if the depth of the bundle has four rows of single pass tubes, as assumed in all the embodiments disclosed herein, then it would also have four rear headers. The rear headers function as the gathering point for all of the condensate as well as the non-condensible gasses.

Air Moving System

The air moving system 24 employed in the disclosed preferred embodiments of this invention is the conventional industry type shown in the patent literature. It preferably employs either mechanical draft fans 86, natural draft or some combination of both. The fan arrangement can be either of the induced or forced draft type. The bundle arrangement can be either an inclined A-frame as disclosed in the preferred embodiment of FIG. 1, vertical, horizontal, V-frame or some combination of these positions. The air moving system forced air flow facilitates and promotes the cooling of the tubes 32 and the condensing of the steam therein at higher heat transfer rates.

Condensate Drain System

The purpose of the condensate drain system is to gather the condensate from each rear header of each bundle and bank and bring it all together into a common condensate storage tank 84 for feeding to the boiler 12 and then for reheating and refeeding as steam to the turbine 14. The problem of collecting this condensate from the bundles is complicated by the fact that the steam pressure in the rear headers of each row is different. In a four row bundle, as disclosed, there are four different steam pressures. These steam pressures vary with ambient air temperature, total steam flow to the condenser, total cooling air flow, etc. In addition to these variables, system upsets occur as, for example, an unexpected fan outage or the like. This can complicate the rear header steam pressure problem even further by causing steam backflow into the rear headers of adjacent bundles.

The piping from the four rear header drains cannot be connected together because steam would then flow from the higher pressure rear headers into lower pressure rear headers. The net result would be the trapping of non-condensible gasses followed by the degradation of thermal performance and the potential exposure to tube freezing. In order to safely and properly drain the condensate, it is necessary to introduce isolating water seals in the drains of each of the rear headers before connecting them together. These water seals are formed of vertical water columns operating in water legs 70, 72, 74 and 76 constructed of standard piping materials.

Figure 7:
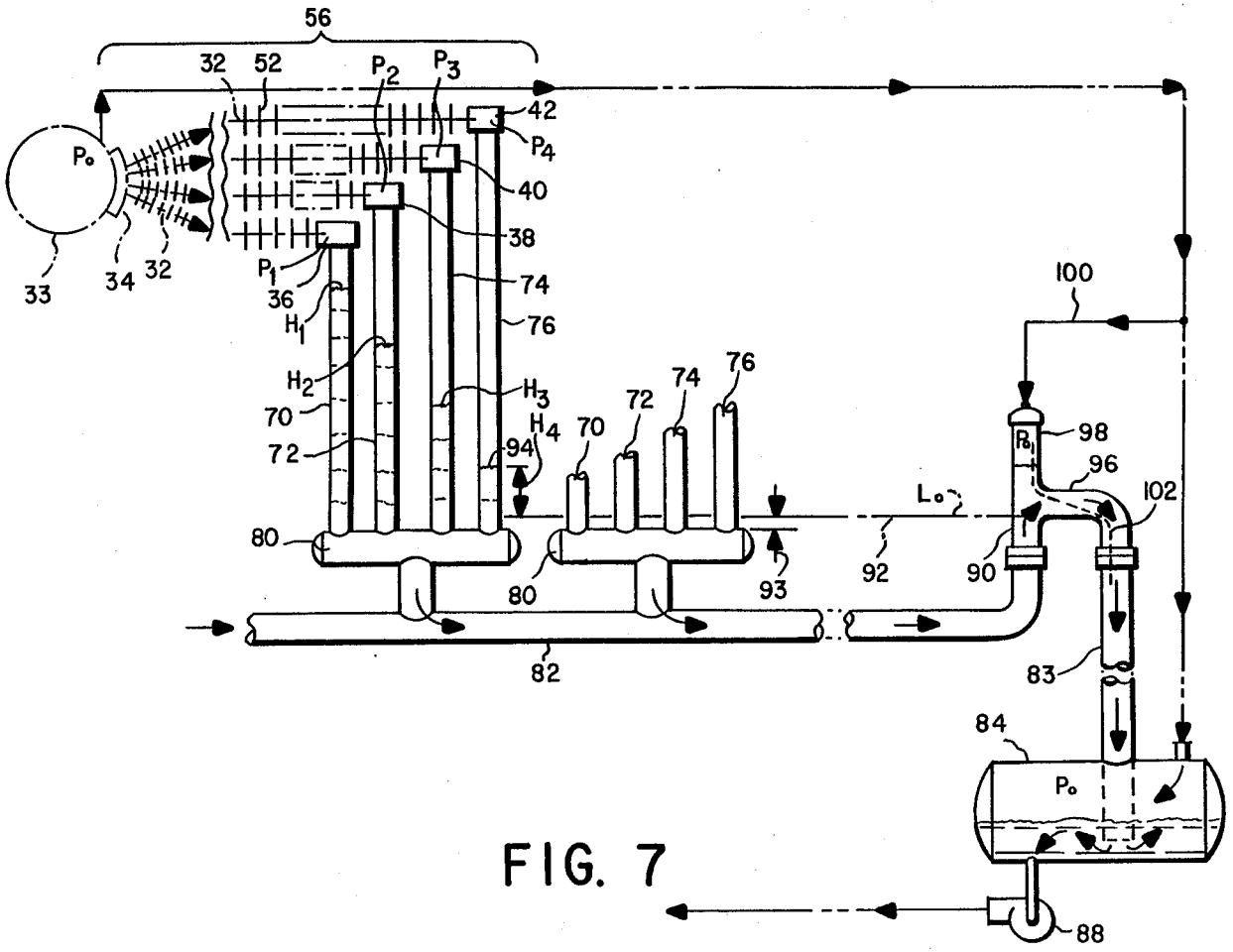
FIG. 7 is a basic flow diagram of a condensate collecting system as shown in FIG. 1.

A flow diagram for the condensate collecting system of the present invention is presented in FIG. 7. It employs vertical water leg pipes 70, 72, 74 and 76 which attach individually to their respective rear header 42, 40, 38 and 36 of each bundle. These pipes terminate in a water leg manifold 80 for each bundle 56. The water leg manifolds connect by pipes to a common condensate manifold 82 for each bank of bundles. The condensate then flows into a system hydraulic balance device 90 and from there, into a conventional condensate storage tank 84. Pipes and auxiliaries from the tank to the boiler, from the boiler to the turbine and from the turbine exhaust to the condensers complete the flow cycle. Appropriate condensate pumps 88 effect the intended movement of the condensate through other plant auxiliaries.

One key element in the hydraulic operation of the condensate drain system is the hydraulic balance device 90. This device has several functions. The first is to provide a datum steam pressure against which the bundle rear header steam pressures and their corresponding water legs are hydraulically balanced. Secondly, the hydraulic balance device functions to establish and maintain a predetermined static water level datum line 92 which insures that each water leg is operational and that the water level in the various legs does not drop below a prescribed minimum height 94 which include margin 93 and allowances, that would destroy its water seal properties.

The hydraulic balance device 90 is best shown in FIG. 7. It is essentially a water loop seal 96 formed in the shape of an inverted U that has a steam pressure chamber 98 at the top. The steam pressure chamber is connected by a pressure equalizing pipe 100 to the main steam duct so that it has an internal steam pressure of $P_o$. Since there will be some steam condensation followed by steam flow into this chamber 98, it is necessary to remove non-condensible gasses that will tend to accumulate there. This is done by means of a small vent tube 102 which extends into the chamber with its lower end placed in the condensate flow stream. Gas flow from the chamber is induced by entrainment with the steam so that the non-condensibles and steam both are carried away by the downward flow of water into the drain pipe. This small steam flow in pipe 100 is also helpful in keeping the line warm during winter.

The performance of the hydraulic balance device in the condensate circuit is shown in FIGS. 8 and 9 which represent three operating situations. FIG. 8 shows the hydraulics of the condensate drain system with the hydraulic balance device connected by pipe to the main steam duct operating at steam pressure $P_o$.

Typical cold weather operation is shown in the upper part of FIG. 8 and hot weather operation at the lower part. These graphs show the steam pressure $P_o$ in the main steam duct and the lower steam pressures, $P_1$, $P_2$, $P_3$ and $P_4$ in each of the rear headers. The subscripts 1, 2, 3 and 4 refer to rows number 1, 2, 3 and 4 respectively.

In order to remove the condensate from each of these rear headers, a water seal is achieved by using the main steam duct pressure $P_o$ in the hydraulic balance device and then off-setting it with appropriate water column heights $H_1$, $H_2$, $H_3$ and $H_4$ for each of the rear headers. It should be noted that the water column differential height is, in reality, equal to the steam pressure drops across the respective bundle rows.

The hydraulic balance device need not necessarily be connected to the main steam duct. It could be connected to any one of the four rear headers. FIG. 9 shows the hydraulic balance device connected to the third row rear header operating at pressure $P_3$. Any such change would, however, require that the hydraulic balance device be physically raised in elevation in order to raise the static water level datum line $L_o$ so that the water column of the fourth row would not fall below the water leg manifold elevation.

The hydraulic balance device 90 controls the condensate flow from the bundle rear headers to the condensate storage tank. It introduces a known hydraulic balancing force into the condensate drain system against which all water leg pressures are balanced, as shown in FIGS. 8 and 9. By doing so it establishes uniformity and stability in the condensate flow system under all plant requirements and modes of operation.

The hydraulic balance device is physically located at an elevation water level datum $L_o$ of FIG. 7 where the water just starts flowing into the condensate storage tank while row number 4 water leg height is at its lowest point yet remains protected by margin 93. If the condensate level were allowed to drop below the top of water leg manifold 80, then the water seals between the individual rear headers would be destroyed.

A simple siphon loop seal without the upper steam pressure chamber 98 as shown in FIG. 7 would have an indeterminate and unstable hydraulic pressure at its high point depending upon operating variables. The condensate flowing down the drain pipe 83 in not necessarily a solid liquid column depending upon elevation differences, liquid flow rates and the absolute steam pressure $P_o$ in condensate storage tank 84. In most cases the condensate will be free falling under the influence of gravity, therefore, there will be column separation and liquid flashing. These vapors could reach into the top of the inverted U section of the simple siphon loop and could then be represented as the hydraulic pressure against which the water legs are balanced. This would present an erratic, unreliable and unsatisfactory hydraulic operation. The net result would be either condensate flooding of the rear headers or the destruction of the water leg seals by liquid levels dropping too low into the water leg manifold 80.

Three alternative design rear header water leg seals are shown in FIGS. 10, 11, 12, 13, 14, 15 and 16. These designs vary only in their freeze protection capabilities and would, therefore, be installed in different climatic environments. The FIG. 10 design is the least protected and the least costly. The FIG. 14 design is the best protected and the most costly.

The FIG. 10 water leg design package is an assembly of pipes 70, 72, 74 and 76 fabricated in a flat or planar configuration that could be used in a horizontal bundle installation of the type shown in FIG. 22. The water leg lengths are designed to meet the hydraulic requirements created by the largest steam load occurring during the coldest ambient air temperature. This would be the condition which produces the largest steam pressure drop in the first row of a bundle. This FIG. 10 design water leg installation would be used in geographic locations where the coldest ambient air temperatures experienced are light, overnight freezing.

The FIG. 12 water leg design package is simply FIG. 10 water legs 70, 72, 74 and 76 placed into a compact circle fitted into a standard weld cap 107. With this round configuration it is much easier to wrap heat insulation around the pipes for freeze protection. If necessary, electric heating cables could be placed around the piping before the heat insulation is applied. With electric heat tracing and heat insulation, this water leg assembly would be protected from freezing in mildly severe cold climate installations.

Figure 14:
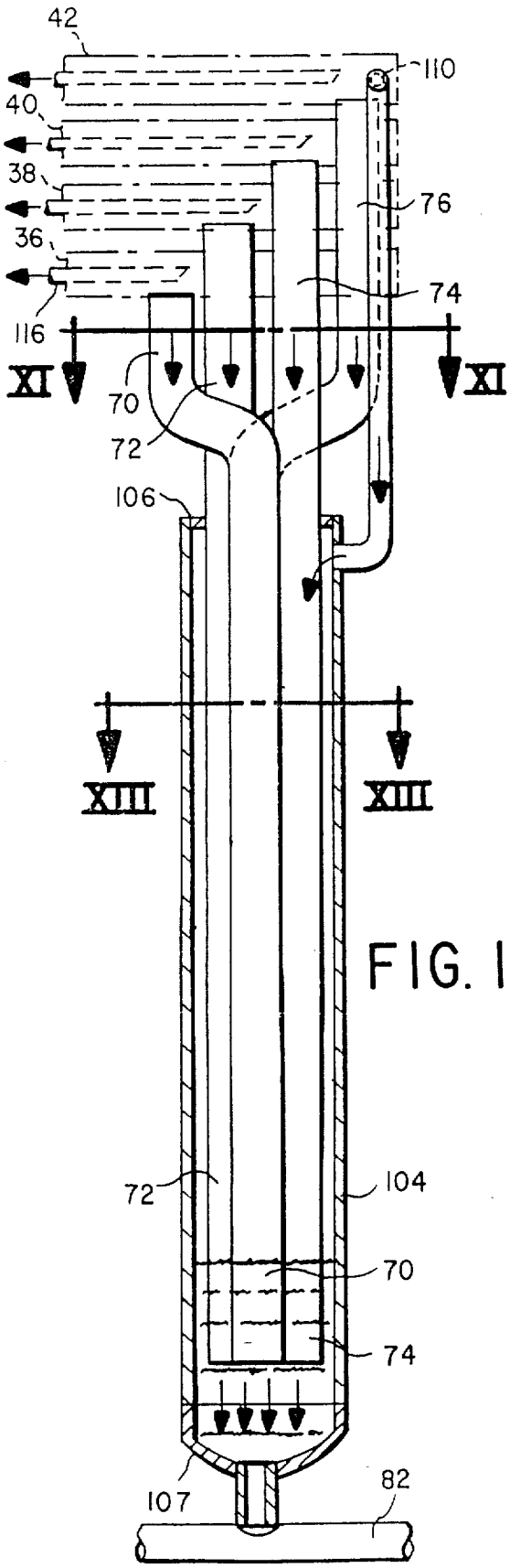
Figure 15:
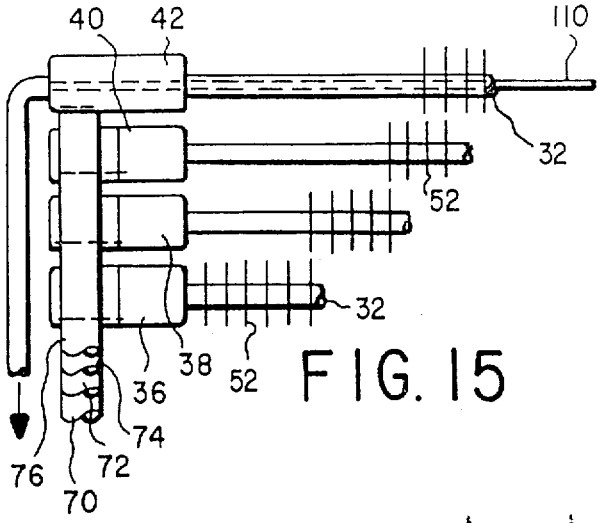
Figure 16:
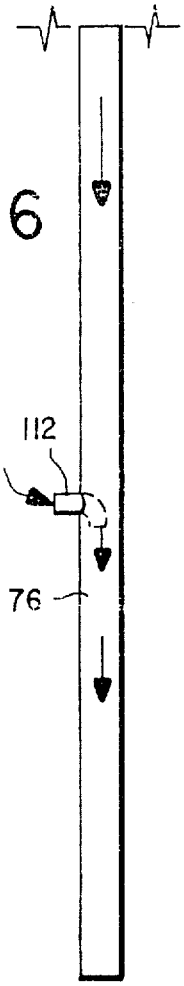

The FIG. 14 water leg design package is simply the FIG. 12 design placed in a steam heated pipe jacket 104. The steel cover plate 106 which was on the bottom of the water legs in FIG. 12 is now raised to the top of the leg assembly set in an enclosure built of standard pipe 104. The heating steam at pressure $P_o$ comes direct from the main steam duct via front header 34 through a tube 110 that is inserted through one of the heat exchanger tubes 32 located in the fourth row of the bundle. This smaller size heating steam tube runs the full length of the bundle in order to reach into the main steam duct. The tube 110 may be strung through any tube 32 of any row of the bundle but the fourth or uppermost row is probably the most convenient for the pipe draining configuration shown.

Since steam vapors and non-condensible gasses flow into the pipe jacket cavity, the steam condenses and its condensate flows out with the main condensate stream. The non-condensible gasses, however, must be removed by other means so as not to cover or blanket the cavity. The gasses are removed by the installation of a small, bent, vent-tube 112 in water leg number 4 as shown in FIG. 14. The tube is pointed in the direction of the condensate flow so that the condensate would carry the gasses, whether entrapped or in solution, until they reach the condensate storage tank where they are released. The gas flows, because of entrainment, and also because the pressure $P_o$ in the steam cavity, is higher than the pressure $P_4$ in rear header number four.

Another new aspect of the present invention concerns the steam which is used for heating the water legs as shown in FIG. 14. The steam for this cold weather heating is carried from the main steam duct 33 by a small pipe line 110 which is protected inside one of the bundle tubes 32 and runs the full length of the bundle. Other designs of heated condensate drain pots employ steam from one of the rear headers for its heating. Such drain pots can freeze for lack of heating steam in the rear header because in some situations all of the steam could be condensed in the bundle before it reaches the rear header. For example, taking heating steam from the fourth row rear header could result in a freeze-up if cold wind blasts on this exposed top row should condense all the steam inside of the condensing tubes thus leaving none for the drain pot. The steam heating line to the water leg vessel must be protected and should utilize the highest temperature steam available, namely $P_o$, from the main steam duct 33. The best reasonable protection that can be afforded this steam supply is to protect its steam line by inserting it into another steam line as disclosed herein.

GAS REMOVAL VACUUM SYSTEM

One of the most important aspects of the present invention is the gas removal vacuum system. It is the subject of another U.S. patent application, Ser. No. 206,095, filed on the same date herewith by the same inventor. The difference between these two systems is the manner in which condensate is drained from the pre-condensers. In the companion design, condensate flows from the exit of the suction sparger 116 through connecting piping 121, 123, 125 and 127 and pre-condensers 120, 122, 124 and 126, through fluid separating connection 128, pipe lines 71, 73, 75 and 77 and into condensate storage tank 84 by gravity. In this present design the steam which is condensed in the pre-condensers and connecting piping flows back into the bundle rear headers by gravity where it mixes with the bulk of the condensate and is withdrawn from the system by means of water legs.

For a better understanding of what is being proposed in this invention as regards gas removal, a short review of the problem and earlier attempts at solving it is helpful.

First, to answer the question as to what are these non-condensible mixed gasses in the exhaust steam of power cycles. These inert gasses are the result of boiler water treating chemicals that are continually injected into the boiler feed water system. They vaporize in the boiler drum but do not all condense when cooled down. They also are the result of air leakage around shaft seals such as the turbine, condensate pumps and valve stems. Air leakage also occurs at the welded joints of the steam condensing system which includes steam ducts, manholes, bundles, tanks, condensate piping, etc. There could be a large presence of inert gasses in the turbine exhaust steam.

The second question that arises is why are they important in the design consideration of steam condensers. These inert gasses can cause tube corrosion, but more importantly, tube failures resulting from freezing. These gasses are frequently trapped in stagnant pockets in rear headers which then grow in size and progress down into the condensing tubes. If there is condensate present, it can freeze because the stagnant gas pockets become cold, having displaced the steam. Frozen condensate can rupture tubes and pipes that will shut down the power generating unit. During the summer these same gas pockets will blanket finned-tube heat-transfer surfaces thereby degrading the plant's thermal performance.

Knowing what these inert gasses are and what they do, we can now examine how they have been handled in the past and compare that with what is now being proposed. FIGS. 28A, 28B, 28C and 28D present the various design attempts in removing the undesirable gasses from the condenser. The IDEAL gas removal design shown in FIG. 28A would be a cone-shaped bundle where steam (S) enters the cavity and is condensed leaving the gasses behind. As more steam enters and condenses, the gasses are pushed further and further ahead until finally they reach the tip of the cone where there is practically no steam and all gas. The first-stage ejector then "sucks" out nearly pure gas and discharges it from the system. There are no stagnant pockets in the IDEAL design because of its cone shape, however, this bundle cannot be built and remains only as an ideal concept.

Figures 28A, 28B, 28C, 28D:
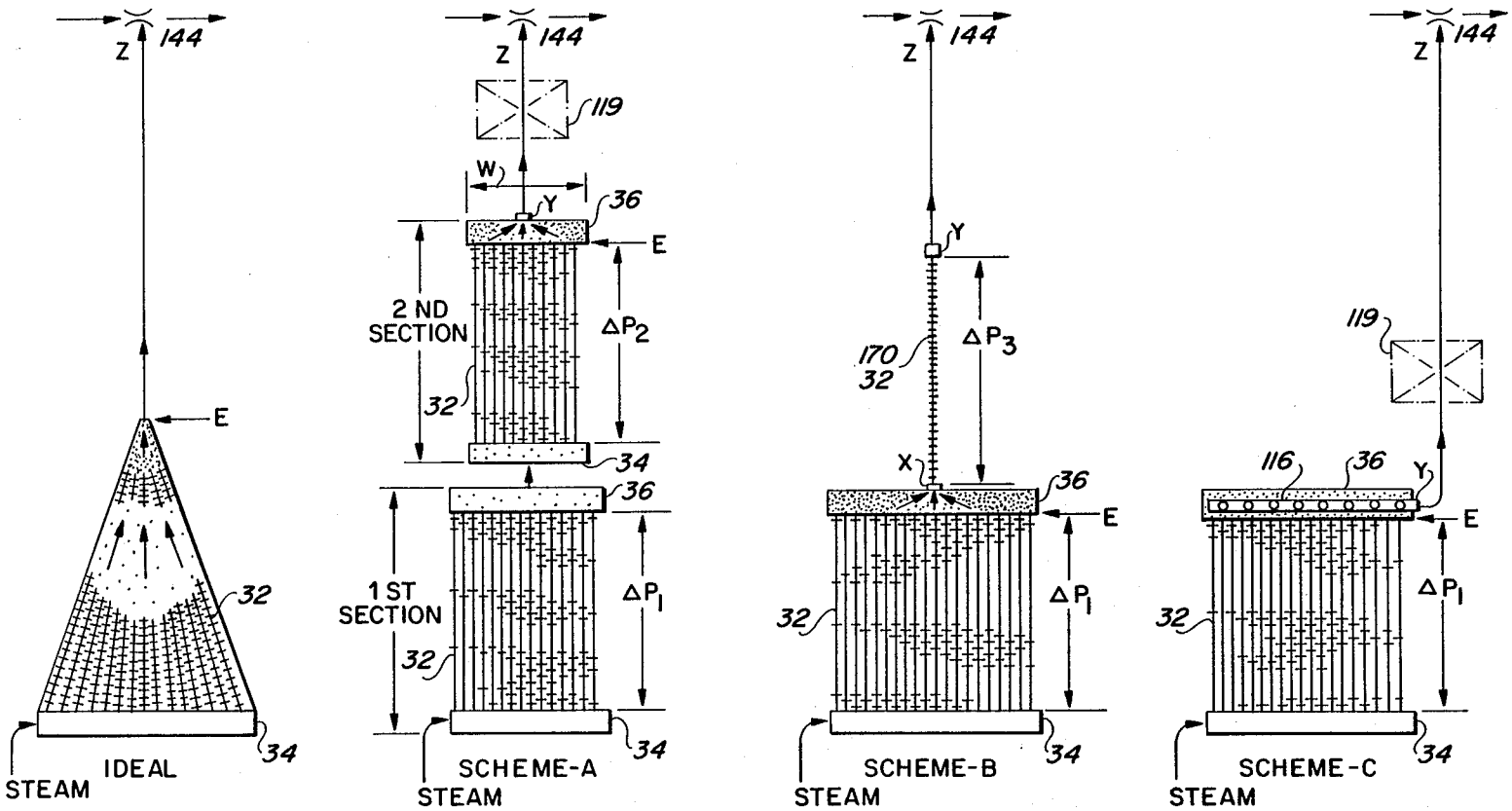
FIG. 28A shows the IDEAL shape of a steam condenser bundle for the complete removal of non-condensible gasses.
FIG. 28B is the common approach by industry in the arrangement of steam condensing sections in an attempt to concentrate the non-condensible gasses for removal from the final rear header.
FIG. 28C is a previously patented main condenser/-vent-tube design with the vent-tube acting as a pre-condenser to the first-stage ejector.
FIG. 28D is the present patent scheme of using a suction sparger for the removal of non-condensible gasses from the rear header.

Scheme A, FIG. 28B, shows past attempts by industry at solving this problem. The total steam condensing surface is built in two sections or zones. They could be separate bundles as shown or they could be incorporated in the same bundle. The attempt here is to try to concentrate the inert gasses before they are withdrawn at point Y. The two sections could have the same heat transfer capacity or the second section could be as small as five per cent of the heat transfer surface area of the first section. The rear header 36 of the first section may or may not be the cavity which serves as the front header 34 for the second section. There are many design variations on this connection. The patent literature shows the following names for the first section: Main Condenser, Primary Condenser, First Condensing Zone and First Plurality Tubes. The second section names have been shown as: Dephlegmator, Vent Condenser, Secondary Condenser, After Condenser, Aftercooler Section, Second Condensing Zone, Second Plurality of Tubes and Reflux Condenser.

Regardless of the bundle name, size, shape, tube passes, tube arrangement, configuration, etc., the design aim is always to drive the gasses toward the terminal end (E) of the condenser and then remove them with an ejector system. A typical rear header length, which is the bundle width (W), could be as large as ten feet. There could be fifty finned tubes in this width all discharging gasses into the rear header. However, the gas quantities entrapped in the steam are minute by comparison to the total mass of steam being condensed. Typically in a small condensing system for every 1,000 lbs/hr of steam entering a bundle with a fifty tube row there is less than 1.0 lbs/hr of gas vapor mixture that is sucked out of the rear header at point Y by the first stage ejector. Considering the internal volume of a rear header that is ten feet long, a 1.0 lb/hr flow withdrawal rate toward the one pipe connection (Y) is very, very small.

With this arrangement where there is but one pipe connection from the rear header to the ejector, it is quite obvious that there will be stagnant pockets of inert gasses in the rear header as shown in FIG. 28B. In fact, the real danger is that these pockets will extend down into the finned tubes along both sides of the bundle where freeze damage then occurs. The vapor/gas fluid being withdrawn by the ejector is that which comes mainly from the finned tubes in the immediate vicinity of the suction opening (Y). These few tubes opposite opening (Y) bring in a continual supply of additional steam and gas into the withdrawal area where all the action takes place. The remaining tubes, which are the majority, merely stagnate with gas movement created mainly by molecular diffusion and small eddies rather than pressure gradients. The inert gasses keep accumulating and concentrating inside the tubes along the sides of the bundle with very slow movement toward the suction opening (Y). That is the nature of fluid movements with the type of containment and withdrawal arrangements presently practiced.

Scheme B, FIG. 28C, has a main condenser where each bundle rear header 36 has a vent tube or tubes. This vent tube 170 is finned similar to the main condenser. It is in essence a pre-condenser to the first stage ejector which is built into the same bundle as the main condenser. This scheme does a better scavenging job of the rear header than does Scheme A. The mass volume of gas/vapor mixture leaving the bundle at (Y) and entering the ejector at (Z) is the same for both Scheme A and B. The mass volume of gas/vapor leaving the rear header of Scheme B at point (X) is considerably larger than that leaving at point (Y), Scheme A, due to the condensation of steam vapor in the vent tube. Since the mass volume flow at point (X), Scheme B, is larger, the flow volumes and velocities around suction opening (X) are higher. However, this design has the same basic flaw that Scheme A has in that the flow into suction opening (X) comes mostly from tubes in the immediate vicinity of the opening. The rest of the rear header and the tubes along the sides to the bundle stagnate.

Scheme C, FIG. 28D, relates to the proposed invention. It has only a main condenser and no secondary condenser or vent tube. All of the inert gasses collect at the terminal end (E) of the condenser in the rear header 36. The gasses and vapors are withdrawn by means of a suction sparger 116 that runs the length of the rear header 36. This suction sparger has a multiplicity of orifices that withdraw equal quantities of vapor/gas mixture along the full length of the rear header. The mixture at point (Z) entering the ejector in Scheme C has a higher concentration of inert gasses than that flowing in Schemes A and B. The mass flow quantities (lbs/hr) of mixture at point (Z) are identical in all three schemes but Schemes A and B have more steam vapor content because of the flow short-circuiting being done by the tubes in the immediate vicinity of the suction opening (X) and (Y). The suction sparger not only does a complete job of scavenging the rear header but by doing so, it ejects a mixture that has a higher concentration of inert gasses compared to Schemes A and B.

Scheme C has a lower internal steam pressure drop than Schemes A and B because it does not have a secondary condenser. Comparing Schemes A, B and C where the same quantity of steam is being condensed in each, Scheme A has an additional pressure drop $\Delta P_2$ and Scheme B pressure drop $\Delta P_3$. The significance of this internal steam pressure drop is that the condenser with the lower drop will permit operating the condenser down to a lower steam pressure during cold weather. A lower turbine exhaust pressure means a higher plant thermal efficiency.

In summary, the second section condenser of Scheme A, the vent tube 170 of Scheme B and the suction sparger 116 of Scheme C all have the same objective which is to help gather and remove the inert gasses and vapors from the terminal end (E) of the condenser. They all do so to a varying degree but the most through and efficient scavenger is Scheme C.

An air-cooled pre-condenser package 119 for the ejection system 144 installed in Schemes A and C offers certain operating advantages when used. It increases the scavenging rate of the rear headers by the amount of steam vapors it condenses. In a normal situation it could increase the scavenging flow by a factor of ten to twenty times which is very significant and desirable in some installations. A pre-condenser in Scheme B would provide no advantage because the vent tube already acts as a built-in pre-condenser withdrawing from a single suction opening in the rear header.

Figures 17, 18:
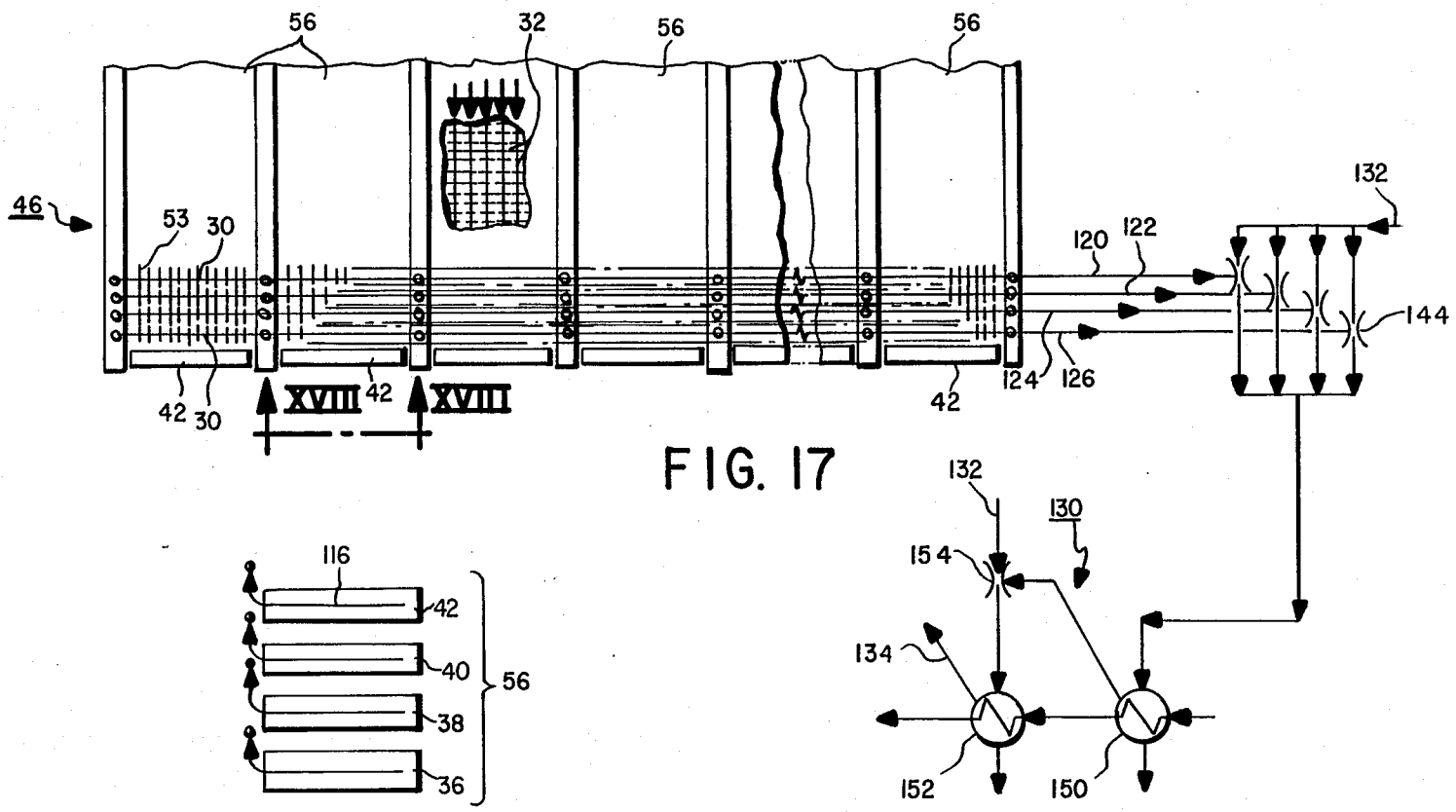

With this background on the reasons for, and a general comparison of, the methods used to withdraw the non-condensible gasses from rear headers, the specifics of this invention follow. A flow diagram of the gas removal vacuum system 28 is shown in FIGS. 1 and 17. The gas removal starts with the suction sparger 116 installed in all rear and last headers; then some piping connecting the suction spargers to pre-condensers 120, 122, 124 and 126; then additional piping connects the pre-condensers to the first-stage ejectors; then the gasses and vapors enter the steam jet air ejector package 130 where the gasses are further concentrated and then ejected from the system into the atmosphere at point 134 while the condensate from the steam vapors is returned to the cycle. A more detailed explanation of each of these gas removal steps is presented.

Figure 19:
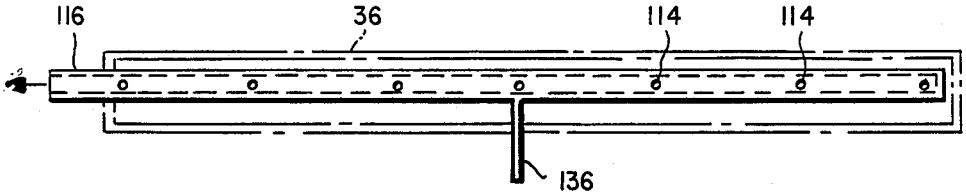
Figure 20:
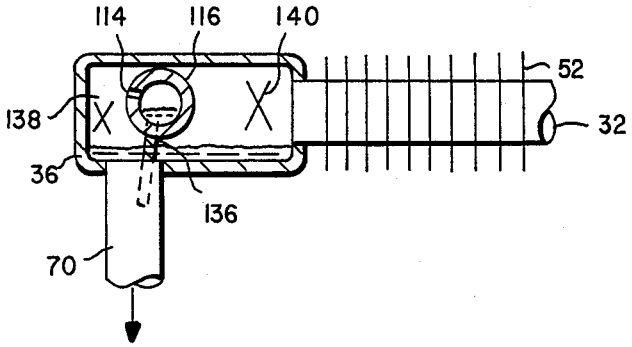
Figure 21:
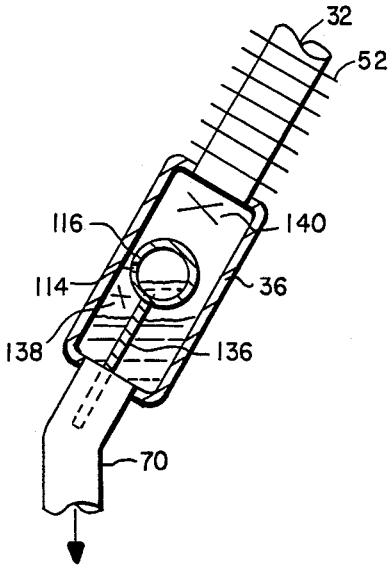

As was stated earlier, the inert gasses all end up in the rear headers 36, 38, 40 and 42. To remove them from the rear headers, it is necessary to create a higher vacuum which is a lower absolute pressure than that which exists in the rear headers. This is accomplished by the first-stage ejectors 144 and completed by the remainder of the steam jet air ejector package 130. The suction sparger 116 is the starting point for the gas removal process. Each rear header, of which there are four per bundle, has its own suction sparger running the full length of the rear headers as shown in FIG. 19. Each such manifold is built of conventional pipe or tubing and has a multiplicity of gas suction orifices 114 and a single condensate drain tube 136. The gas suction orifices are drilled along the full length of the manifold at some point above the pipe centerline where the vapors and gasses have free passage without interference from condensate flow inside the manifold. The condensate that is generated in the air-cooled pre-condenser flows back into the manifold and drains into tube 136 that is located in-line with rear header drain pipe 70. A vent manifold 116 is positioned in each rear header 36, as shown in FIGS. 19, 20 and 21. It is installed above the rear header condensate level with the drain tube 136 extending downward into the condensate drain pipe for a short distance thereby sealing that drain opening from steam bypass. The gas suction orifices are located midway between two adjacent finned tubes 32 and face the calm zone or area 138 of the rear header where the non-condensible gasses tend to collect. The other side of the manifold pipe faces the heat exchanger tube openings which is the turbulent zone or area 140. It is turbulent because there is some steam flow in the rear header between tubes in the same row. This steam interchange amongst tubes 32 occurs as a result of uneven cooling air velocities across the face of the bundle. Locating the suction orifices in the calm zone of the rear headers insures a more effective scavenging job. Since each condensing tube 32 discharges some gas, the multiplicity of suction orifices 114 means that the gasses have only to travel a few inches in the rear header before they enter an orifice in the suction sparger 116. This is unlike the usual steam condenser bundle rear header which has but one suction pipe connection where the gasses must travel from a minimum of a few inches to maximum of five to ten feet, depending on the suction pipe location.

The orifices 114 are of different diameters along the length of the suction sparger 114 and also vary from bundle to bundle depending on the bundle location in the tower structure. These orifices are sized to perform several important flow-equalizing functions. The National Steam Condenser Code specifies the required evacuation capacity (lbs/hr) of the steam jet air ejector package 130 based on the size of steam condenser, i.e., mass quantity of steam condensed (lb/hr). Hence the orifices are sized to flow the code mandated capacity plus the steam vapor capacity condensed in a pre-condenser, if used. In this first calculation step an orifice diameter is found for each row knowing total flow quantities, total bundles and total orifices. Now since the bundles close to the first-stage ejectors will have less piping pressure drops, they would normally flow a larger amount of gas/vapors than the bundles located at the end of the tower. Hence the first adjustment to the orifice diameters is to equalize the flows irrespective of the bundle location in the tower structure. That means that bundles located close to the first-stage ejectors will have smaller orifices than the bundles located at the end of the tower. With this adjustment all bundles will now deliver the same mass quantity of gas/vapor to the evacuation system. There is a second adjustment to be made to the orifice diameters which concerns operations inside the rear headers. Flow through the sparger orifices must be equalized along its entire length. This will insure that each increment of length along the rear headers is being evacuated evenly since each finned tube 32 is discharging very nearly the same quantity of gas. The orifice 114 openings near the front end of the sparger 116 will be slightly smaller than the orifices near the closed end which are further away and therefore have a larger piping pressure drop. A third adjustment concerns the individual rows. They each condense different quantities of steam and, therefore, have different quantities of vapor/gas to be evacuated through different size orifices.

The gas/vapor mixture leaves the suction sparger through short lengths of pipe that run inside the bundle channel from 148 as shown in FIGS. 22, 23, 24, 25, 26 and 27 and connect to evacuation pipe manifold 30. This pipe manifold runs on top of the bundle near the rear headers as shown in FIGS. 1, 2, 3, 4, 17, 25, 26 and 27. By installing fins 53 on pipes 30, low-cost air-cooled pre-condensers 120, 122, 124 and 126 can be made to serve the first-stage ejectors 144. Such a precondenser increases the scavenging rate of the rear headers by the amount of steam vapor it condenses which can be a quantity like 10 to 20 times more than operation without it, which is most significant. In the process of doing that, it provides a more concentrated inert gas mixture to the ejectors which makes them more efficient.

The steam vapor condensing capability of this air-cooled pre-condenser is dependent upon, amongst other things, the temperature of the cooling air 50 passing through its fins 53 as it lies on top of the main steam condensing tubes 32. This air temperature in turn is controlled by the number of fins 52 installed on tubes 32 located directly below the pre-condensers. As the fins are stripped back along the tubes as shown in FIG. 3 the temperature of the air reaching the pre-condensers drops and then more steam vapor is condensed. FIG. 3 shows the top row fins stripped to a distance $L_4$ while the bottom row is left intact; rows 2 and 3 are stripped varying amounts. This control of the number of heat dissipating fins built into the path of this small segment of cooling air gives the designer flexibility to maximize the steam vapor condensing capability of the pre-condenser and minimizes the potential for freezing.

The air-cooled pre-condenser is installed in the warm air stream of the bundle air discharge to protect it from freezing. The vapor/gas mixture flowing in the pre-condenser tubes 30 does not carry much steam so that it does not have the self protection features as does the regular steam condensing tube 32. Although the pre-condenser is protected by being surrounded with heated air, it is still subject to freezing if it is not protected from cold blasting winds. In cold climate installations a removable, sheet-metal, protective wind shield 162, would be installed to partially cover the pre-condenser.

The vapors and gasses leaving the precondensers enter the first-stage ejectors 144 of which there are four; one for each bundle row because they all have different pressures and cannot be tied together. The use of multiple first-stage ejectors discharging into a common inter-condenser is generally known in the existing art in the process, petrochemical, pharmaceutical and related industries. The process cycles generally have several points, at different pressures, which must be evacuated with their own first-stage ejectors which then discharge into the shell of a common condenser. As shown in FIGS. 1 and 17, the first-stage ejectors then discharge their mixture into inter-condenser 150 and the second-stage ejector 154 withdraws that shell mixture and discharges it to the after-condenser 152. The after-condenser condenses the remaining steam vapor and discharges the residue of inert gasses into the atmosphere via vent 134. This air ejection package 130 is a conventional steam operated 132 two-stage steam ejector unit with inter- and after-condensors. Motor driven vacuum pumps with or without air ejectors could be readily substituted for the steam operated device shown.

The low-cost pre-condensers 120, 122, 124 and 126 would be installed when operating conditions indicated the need for additional scavenging of the rear headers. If they were not needed, then there would be some cost savings by eliminating fins 53 on piping 30 and not having to partially strip tubes 32 of fins 52 located in the vicinity of the rear headers as shown in FIG. 3.

Miscellaneous

The gas removal vacuum piping system and the condensate drain piping system leaving the bundle rear headers is shown for a horizontal design bundle. Note FIGS. 22, 23 and 24. Note FIG. 27 for an A-frame bundle.

The condensate drains from each bundle are preferably removed from the center of the rear headers which is readily done in the A-frame arrangement. The horizontal bundle design, however, presents a more difficult problem because there the tube rows must be stepped as shown in a simplified form in FIG. 7. This means that each of the four rows of extruded tubes are of different lengths. The extruded tubes would normally be manufactured to the longest length and then cut to their shorter lengths as required for the other three rows. The cut portions are scrap and represent a wasted cost item.

A rear header design that would allow the same length of tube to be used in all four rows of a horizontal bundle is shown in FIGS. 22, 23, 24 and 25. Here the rear headers have a notch cut 158 that allows the condensate piping to be installed in a simple vertical manner. A Z-shaped piece of metal 160 must be welded back into each of the three headers where the section was cut out.

Figure 26:
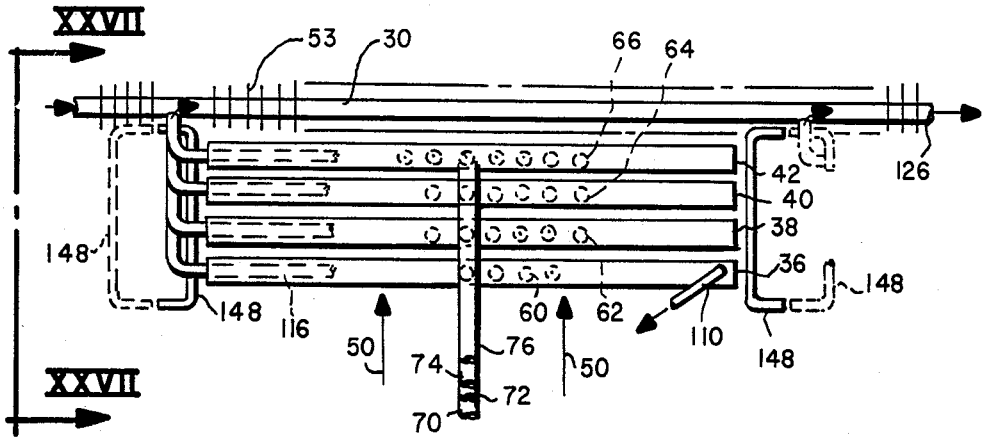
Figure 27:
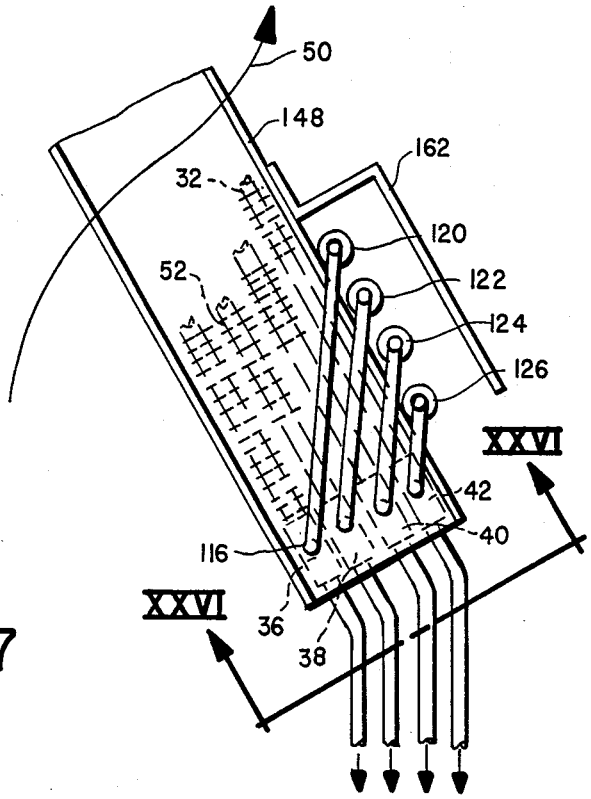

If a steam heated water leg assembly is used in conjunction with an A-frame bundle, then the heating steam line 110 must be taken from the extreme end of one of the rear headers as shown in FIG. 26. This is to insure that the steam line pipe does not interfere with the vacuum vent manifold pipe inside the rear header.

The invention may thus be considered as apparatus for removing non-condnesible gasses from steam being condensed as it moves through an arrangement of tubes or conduits from a front header toward a rear header along a gas/vapor path. A suction sparger is located in the rear and last header for the receipt of the non-condensible gasses released from the steam during its condensation and movement along its gas/vapor path. The suction sparger has a plurality of orifices along its length for the receipt of the non-condensible gas mixture and for the removal of this mixture therefrom by a suction-type air removal device such as a steam operated first-stage ejector.

Although the preferred arrangement as illustrated in the drawings of this invention shows four rows of tubes, all of the disclosures in this invention apply to bundles constructed with one or more rows. Similarly, each row may have a different finned tube diameter such as, the first row could be one and one-half inches in diameter, the second row one and one-fourth inches in diameter and the third row one inch in diameter.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A steam powered system comprising a turbine for converting steam energy into mechanical energy upon expansion of steam therein, a boiler for generating steam to be fed to the turbine, and a conduit arrangement coupling the boiler to the turbine and then recoupling the turbine exhaust to the boiler through steam condensing mechanisms, the condensing mechanisms including:

a plurality of finned tubes through which the expanded exhaust steam flows and is condensed;

a plurality of bundle front headers at the input ends of the condensing tubes for receiving exhaust steam from the turbine;

a plurality of bundle rear headers at the output ends of the condensing tubes for receiving condensate and non-condensible gasses;

a plurality of vertically oriented water leg pipes, one for each bundle rear header of each bundle, coupling each rear header with a water leg manifold;

a hydraulic balance device in the condensate drain system coupling the water leg manifold and a condensate storage tank, the hydraulic balance device providing the means to maintain a predetermined hydraulic pressure therein for thereby sustaining the heights of the condensate in the water leg pipes within predetermined limits for fluid sealing purposes; and means to remove non-condensible gasses from the rear headers.

2. The system as set forth in claim 1 wherein the plurality of condensing tubes are arranged in bundles, with the tubes of each bundle installed in a plurality of rows with the condensing pipes of each row terminating in a separate rear header.

3. The system as set forth in claim 2 and further including a plurality of bundles with each bundle having rows of condensing tubes in a plurality of front headers and in a plurality of rear headers and a plurality of water leg pipes coupled with a common condensate manifold for directing the condensate flow of a plurality of bundles therefrom to the hydraulic balance device.

4. The system as set forth in claim 1 wherein each water leg pipe couples with its associated rear header at a different elevational location with the ends of the lower rear headers being cut centrally along their axes for forming notches to allow passage of some of the water leg pipes therepassed.

5. The system as set forth in claim 1 wherein the water leg pipes are parallel with each other in a planar configuration.

6. The system as set forth in claim 1 wherein the water leg pipes are parallel with each other and arranged in a circular configuration.

7. The system as set forth in claim 6 and further including a tubular jacket surrounding the water leg pipes and means to effect a heating steam flow into the jacket via a protected steam line.

8. The system as set forth in claim 1 and further including means for winterizing the exposed vertically oriented water leg pipes.

9. For use in a steam condenser, a condensing and draining mechanism comprising:

a plurality of condensing tubes through which steam may flow for being condensed into water and continually drained therefrom;

a plurality of front headers at the input end of the condensing tubes for receiving steam to be condensed;

a plurality of rear headers at the output end of the condensing tubes for receiving condensate and non-condensible gasses from the condensing tubes;

a plurality of heat transfer fins on the condensing tubes to facilitate steam condensing within the tubes, such finned tubes extending from the front headers toward the rear headers with, in the area below the pre-condensers, the fins being removed from the tubes for varying predetermined lengths to control air temperature enveloping the pre-condenser tubes;

a plurality of water leg pipes, each coupling a rear header with a water leg manifold; and a hydraulic balance device through which all the condensate will flow from all the water leg manifolds, such hydraulic balance device including an inverted U-shaped pipe mechanism located at the water level datum line for water in the water leg pipes and with means for maintaining the bight of the U-shaped pipe at a predetermined hydraulic pressure.

10. The mechanism as set forth in claim 9 wherein the water level datum line is located at a predetermined elevation measured from the lower ends of the water leg pipes and at the bight of the U-shaped pipe.

11. The mechanism as set forth in claim 9 and further including steam pressure chamber at the upper extent of the bight of the U-shaped pipe.

12. The mechanism is set forth in claim 9 and further including a vent tube in the U-shaped pipe adjacent the bight.

13. The mechanism as set forth in claim 9 and further including means operatively coupling the bight of the U-shaped tube with a predetermined steam pressure source.

14. The mechanism as set forth in claim 13 wherein the steam pressure source is the main steam duct.

15. The mechanism as set forth in claim 13 wherein the steam pressure source is any one row of the bundle rear headers.

16. The mechanism as set forth in claim 9 wherein the plurality of condensing tubes are arranged in a plurality of rows with the condensing tubes of each row terminating in a separate rear header and with a separate water leg pipe coupling each rear header with a water inlet manifold and further including a plurality of bundles with each bundle including rows of condensing tubes, rear headers and water leg pipes coupled with a common condensate manifold for a plurality of bundles for directing the condensate flow from the plurality of bundles to the hydraulic balance device.

17. For use in a stream condenser, mechanism to remove non-condensible gasses comprising:

a plurality of condensing tubes through which exhaust stream may flow for being condensed into water and non-condensible gasses to be removed;

a plurality of front headers at the input end of the condensing tubes for receiving exhaust stream to be condensed;

a plurality of rear headers at the output ends of the condensing tubes for receiving condensate and non-condensible gasses from the condensing tubes;

a plurality of water leg pipes, each coupling a rear header with a common water leg manifold;

a suction sparger with orifices installed within each of the rear and last headers to receive non-condensible gasses and water vapor;

a pre-condenser tube for each rear header; and connecting piping extending from each suction sparger to its companion pre-condenser tube for the removal of the non-condensible gasses and some water vapor.

18. The mechanism as set forth in claim 17 wherein the plurality of condensing tubes are arranged in bundles with a plurality of rows of condensing tubes in each bundle and with each row of each bundle terminating in a separate rear header and with a separate suction sparger installed in each rear header and a separate water leg pipe coupled with each rear header and with a separate water leg manifold for each bundle.

19. The mechanism as set forth in claim 18 and further including air-cooled pre-condenser tubes set in a select and pre-determined air temperature zone on the discharge side of the main condenser coupling a preselected suction sparger from each tube row of each bundle.

20. The mechanism as set forth in claim 19 and further including a suction-type air removal device such as a first-stage steam jet air ejector for each pre-condenser tube row.

21. The mechanism as set forth in claim 20 and further including an inter-condenser; a second-stage ejector and an after-condenser coupled to the output of the first-stage steam jet air ejector.

22. The mechanism as set forth in claim 18 wherein the orifices in the suction sparger are of varying diameters for equalizing the mass flow of non-condensible gas mixtures in each comparable row (i) along the length of the rear headers and from the (ii) various bundles as located throughout the tower structure.

23. In a device for condensing steam and for removing the non-condensible gasses therefrom, an arrangement of conduits defining a gas vapor path inside a bundle extending from a front header to a rear header with condensing tubes extending therebetween for the stream as it moves from the front header to the rear and last header of the bundle where the non-condensible gasses terminate and collect as residue, the arrangement also including a suction sparger pipe having a plurality of orifices located inside the rear header, the suction sparger pipe being of a length which spans the breadth of the rear header with its plurality of orifices located in the immediate vicinity of the tubes and positioned with respect thereto for the purpose of inducing the residue gasses leaving each stream condensing tube to flow directly into the sparger for removal from the rear header and then subsequent discharge from the device.

* * * * *

UNITED STATES PATENT AND TRADEMARK OFFICE

CERTIFICATE OF CORRECTION

PATENT NO. : 4,903,491
DATED : Feb. 27,1990
INVENTOR(S) : Michael W. Larinoff

It is certified that error appears in the above—identified patent and that said Letters Patent is hereby corrected as shown below:

At Line 61 of Column 7 after "of" change "tube" to -- tubes --.

At Line 1 of Claim 17 (Line 1 of Column 20) after "a" change "stream" to -- steam --.

At Line 4 of Claim 17 (Line 4 of Column 20) before "may" change "stream" to -- steam --.

At Line 6 of Claim 23 (Line 55 of Column 20) before "as" change "stream" to -- steam --.

At Line 15 of Claim 23 (Line 64 of Column 20) after "each" change "stream" to -- steam --.

The two sheets of drawings consisting of figures 10-16 should be inserted as per attached sheets.

Signed and Sealed this

Nineteenth Day of February, 1991

*Attest:*

HARRY F. MANBECK, JR.

*Attesting Officer*

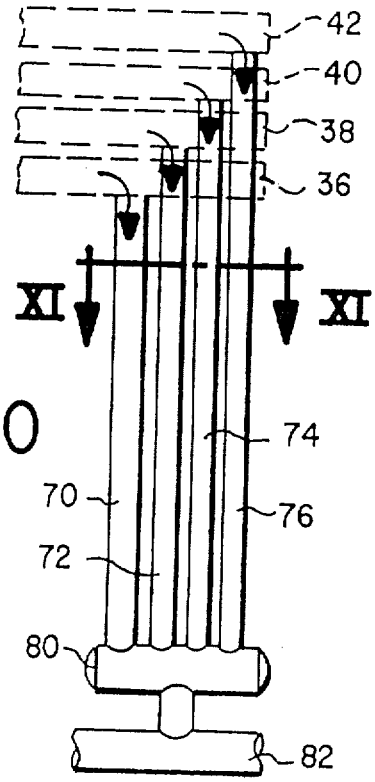
FIG. 10
FIG. 11
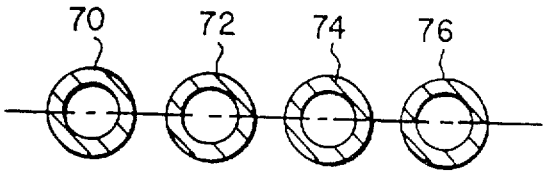
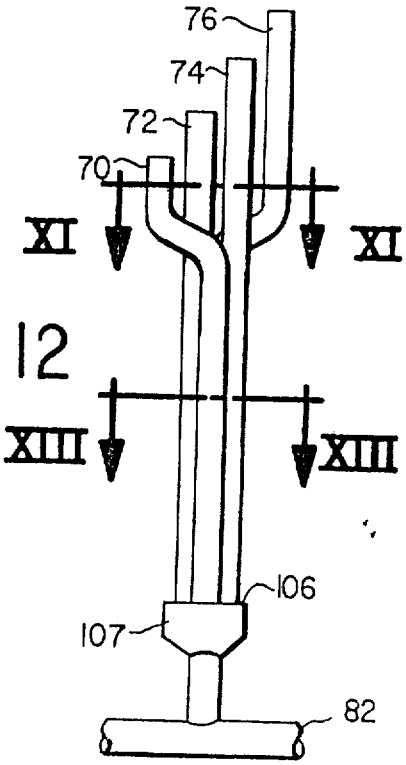
FIG. 12
FIG. 13
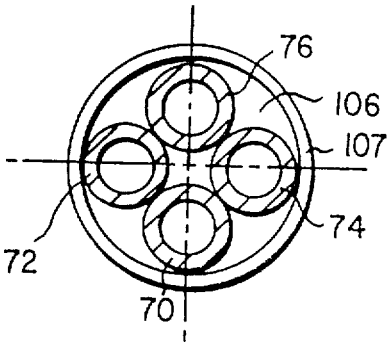

*Commissioner of Patents and Trademarks*